United States Patent [19]

Bodig et al.

[11] 4,356,808

[45] Nov. 2, 1982

[54] LOW-SPEED COMPENSATED IGNITION SYSTEM FOR AN INTERNAL COMBUSTION ENGINE

[75] Inventors: Bernd Bodig, Leinfelden; Werner Jundt, Ludwigsburg, both of Fed. Rep. of Germany

[73] Assignee: Robert Bosch GmbH, Stuttgart, Fed. Rep. of Germany

[21] Appl. No.: 317,284

[22] Filed: Nov. 2, 1981

[30] Foreign Application Priority Data

Nov. 15, 1980 [DE] Fed. Rep. of Germany ..... 3043247

[51] Int. Cl.[3] ..... F02P 5/04; F02P 1/00

[52] U.S. Cl. ..... 123/614; 123/609; 123/611; 123/644; 123/618

[58] Field of Search ..... 123/644, 418, 614, 618, 123/609, 611

[56] References Cited

U.S. PATENT DOCUMENTS

| | | | |
|---|---|---|---|
| 3,882,840 | 5/1975 | Adamian | 123/644 |
| 4,167,927 | 9/1979 | Mikami | 123/644 |
| 4,176,645 | 12/1979 | Junot | 123/644 |
| 4,280,461 | 7/1981 | Okuda | 123/644 |

*Primary Examiner*—Ronald B. Cox

*Attorney, Agent, or Firm*—Frishauf, Holtz, Goodman & Woodward

[57] ABSTRACT

A switching transistor (7, 9) is serially connected with the primary (5) of an ignition coil; current flow therethrough is controlled from an a-c signal generator (16) with respect to an ON threshold level (Ue) to store electromagnetic energy, and an OFF threshold level (Ua) to generate a spark; a variable conductivity circuit (26) controlled from a sensing resistor (8) modifies the response level of the threshold switch (13) with respect to the null or cross-over level of the applied signal. To prevent excessive current flow under idle-speed conditions, in accordance with the invention, the ON threshold level, at least, of the switch is shifted by introducing an auxiliary bias voltage derived from an auxiliary capacitor (36) and connected (37, 38) by the signal source through a diode (38) which prevents application of an auxiliary bias voltage to the threshold switch (13) under extremely low, e.g. starting conditions, permits application of the additional bias voltage providing for shift of the ON response level (Ue) under idling conditions, but again loses control as the speed continues to increase, and control by the variable conductivity circuit takes over.

6 Claims, 2 Drawing Figures

LOW-SPEED COMPENSATED IGNITION SYSTEM FOR AN INTERNAL COMBUSTION ENGINE

Figure 1:
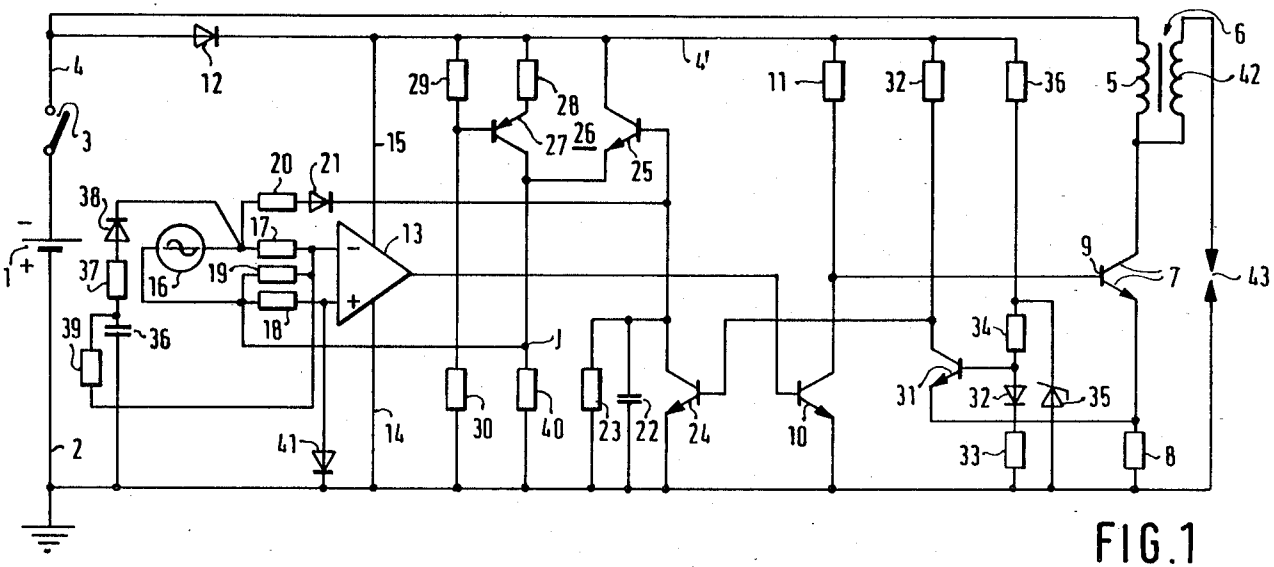

Reference to related patents and applications, assigned to the assignee of this application:

U.S. Pat. No. 4,176,645, Jundt et al.

The present invention relates to an ignition system for an internal combustion engine, and more particularly to an ignition system in which an ignition coil stores electromagnetic energy, the ignition coil having current flow therethrough controlled by a semiconductor switch, typically a transistor, which is gated ON under control of a signal derived from an engine transducer, and as modified by a current sensing signal, and gated OFF at the ignition instant.

BACKGROUND

Various types of ignition systems are known in which an ignition coil stores electromagnetic energy, under control of a semiconductor switch, typically a power transistor. It is desirable that the current flow through the ignition coil and through the semiconductor switch be controlled in such a manner that, under all conditions of operation of the engine, that is, under varying speeds, the electromagnetic energy stored in the ignition coil is just sufficient to provide an effective spark at a spark plug. Permitting current flow to exceed this electromagnetic storage causes heating of the ignition coil and of the semiconductor switch and hence causes comparatively high losses in the ignition system while, additionally, possibly leading to overload of the components of the ignition system. In various types of such systems, which operate highly satisfactorily and efficiently, the ON and OFF conditions of the semiconductor switch are controlled by a threshold switch which, in turn, is controlled from the engine transducer, typically a signal generator operating similarly to an a-c generator. The threshold levels of the threshold switch are usually so set that they have a relatively small distance from the zero or null or cross-over value of the a-c signal provided by the signal generator. The threshold level must be close to the zero or null or cross-over level since, otherwise, at low engine speeds and when the peak signal level from the signal generator, itself, is low, failure of ignition signals might result. Yet, this low threshold level causes, at low-speed operation, unnecessarily long current flow through the ignition coil, and hence may cause excessive heating of the ignition coil and the switch connected thereto.

THE INVENTION

It is an object to improve an ignition system in which the ON-time is more accurately controlled even under low-speed conditions, to avoid overload of the system by excessively long current flow, that is, to decrease the dwell angle of current flow when the engine is running slowly.

Briefly, a control system is provided which controls the ON-time of a semiconductor switch in series with the ignition coil which includes a threshold switch responsive to a threshold level above the zero or null or cross-over point of a received generator control signal. The zero or null or cross-over level of the response of the threshold switch can be modified in accordance with sensed current flow through the coil, by a current-sensitive modification circuit. In accordance with the present invention, an additional modification signal is derived, based on speed of the engine, and effecting a shift of the threshold level with respect to the shifted zero or null or cross-over level affecting the threshold switch, so that, under low-speed conditions of the engine, the threshold level of the switch with respect to the shifted zero or null or cross-over line of the signal is modified by raising the threshold and thus decreasing the duration of current flow through the coil, so that only so much electromagnetic energy is stored in the coil as is actually needed for generation of a spark.

The system has the advantage that excessive current flow causing saturation of the spark plug and unnecessary heating of the wire, and other equipment such as the semiconductor switch and the current sensing element for example is prevented, even under low speed, e.g. idle speed, or approximately idle speed of the engine.

DRAWINGS

Figure 2:
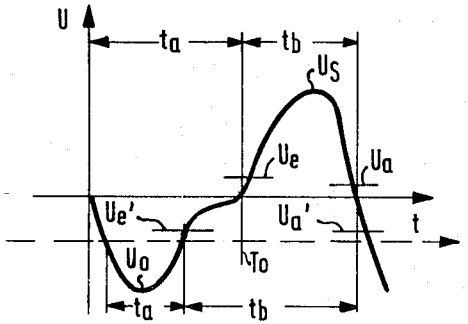

FIG. 1 is an abbreviated schematic circuit diagram of an ignition system incorporating the present invention and from which features not necessary for an understanding thereof have been left off; and FIG. 2 is a voltage-time diagram of signals arising in the system.

The ignition system—see FIG. 1—is to be used with an internal combustion engine, not shown, of a motor vehicle, for example. Power supply is derived from a direct current source, typically the vehicle battery 1. The vehicle battery 1 is connected with its negative terminal to a negative supply or chassis connection 2; the positive terminal is connected through a main switch 3 to a positive supply bus 4. The positive supply bus 4 is connected to the primary 5 of an ignition coil 6. The other terminal of the ignition coil 6 is connected through the collector-emitter path of a transistor 7, forming a semiconductor switch, in series with the coil, and then through a sensing or measuring resistor 8 to the chassis bus 2. The semiconductor switch 7 is formed by the emitter-collector path of an npn transistor 9; the collector of the transistor 9 is connected to the primary 5 of the ignition coil. The base of the transistor 9 is connected to the collector of an npn transistor 10, which is further connected through a resistor 11 to a positive system supply bus 4' which is connected through a reverse-polarity protective diode 12 to the positive bus 4. The transistor 10 has its emitter connected to the negative supply bus 2, and its base to the output of an operational amplifier 13, connected as a threshold switch. Operational amplifier 13 has current supply lines 14, 15 connected, respectively, to buses 2 and 4'. The operational amplifier 13 is controlled by a signal generator 16, operating similarly to an a-c generator, which has one terminal connected through a resistor 17 to the inverting input of the operational amplifier 13, and its other terminal through a resistor 18 to the direct input thereof. The inverting input of the operational amplifier 13 is connected over resistor 19 to the other terminal of resistor 18 and hence to the other terminal of the signal generator 16. Signal source 16, besides being connected to the resistor 17, is additionally connected to a resistor 20 and then through a blocking diode 21, the cathode of which is connected to a storage capacitor 22 which stores a command or control voltage. The other terminal of capacitor 22 is connected to chassis bus 2. A discharge resistor 23 is connected in parallel with the capacitor 22, and, further, the emitter-collector path of an npn transistor 24 is provided, of which the emitter is connected to the chassis bus 2. The collector of transistor 24 is connected to the base of an npn transistor 25 which is part of a switching network 26 which has variable conductivity. The switching network 26 includes, additionall, a constant current source, formed by a pnp transistor 27, the emitter of which is connected through a resistor 28 to the protected bus 4', and the base of which is connected to a voltage divider formed by resistors 29, 30, connected between the protected bus 4' and the chassis bus 2. Transistor 25 has its collector connected to the protected bus 4', and its emitter to the collector of transistor 27, and hence to a junction J with a resistor 40, the other terminal of which is connected to the chassis bus 2, and to the junction between resistors 18, 19, and the signal generator 16. The base of transistor 27 is connected to a voltage divider 29, 30, connected between the protected bus 4' and chassis bus 2.

The base of transistor 24 is connected to the collector of an npn transistor 31 and over a resistor 32 to the protected bus 4'. The emitter of the transistor 31 is connected to the junction between the semiconductor switch 7 and the sensing or measuring resistor 8, and hence is connected to chassis bus 2 through the measuring resistor 8. The base of transistor 31 is connected to a constant voltage source formed by voltage dividers 33, 34, 36 connected between the protected bus 4' and chassis bus 2. A temperature stabilization diode 32 is connected in the voltage divider; a Zener diode 35 is connected between chassis bus 2 and the junction of resistor 34, 36 to provide a stabilized voltage junction at that point.

In accordance with the invention, a circuit is provided to shift the threshold level of the threshold switch 13 with respect to the zero or cross-over or polarity change level response thereof. An auxiliary capacitor 36 has one terminal connected to negative or chassis bus 2, and the other through a current limiting resistor 37 to the anode of a blocking diode 38, the cathode of which is connected to the junction between the signal source 16 and the coupling network formed by resistors 20, 21, and hence to the network 26 of variable conductivity. The terminal of the auxiliary capacitor 36 connected to the resistor 37 is further connected through a resistor 39 with the inverting input of the operational amplifier 13 forming the threshold switch. The direct input of the operational amplifier 13 is connected over a diode 41 to the negative or chassis bus 2, diode 41 providing a fixed voltage at the direct input due to its cathode connection with the chassis bus 2.

The secondary 42 of the ignition coil 5, 6 is connected, as is customary, to the spark gap of a spark plug 43, for example through a distributor if the system is to be used with a multi-cylinder engine.

OPERATION

The system is ready for operation upon closing of the main or ignition switch 3. Let it be assumed that the signal source 16 provides an output signal which is just in advance of the maximum peak Us, that is, that the output signal from signal source 16 is in the region between Uo–Us. When the rising flank of the curve, after having passed the negative peak Uo, reaches the threshold level Ue of operational amplifier 13, the operational amplifier 13 will turn ON. Consequently, its output will be at approximately zero or chassis level voltage. This causes transistor 10 to block which, in turn, places operating voltage on the base of the switching transistor 9, so that it will become conductive and, hence, current can flow from the battery 1 through bus 4, primary winding 5 of ignition coil 6, and resistor 8 to chassis bus 2. When this current reaches a certain command value, that is, when the current has increased to the extent that enough electromagnetic energy is stored in the ignition coil 6 to generate a suitable spark, the voltage drop across the measuring resistor 8 will have reached a value which causes the previously conductive emitter-collector path of transistor 31 to block, transistor 34 will be rendered conductive which causes capacitor 22, previously charged, to discharge.

When the control signal drops below the threshold value Ua, operational amplifier 13, operating as a threshold switch, is turned OFF so that, consequently, its output will be approximately that of the positive supply bus 4'. Consequently, the emitter-collector path of transistor 10 will be gated ON, and the electronic switch 7 will be caused to block, interrupting current flow through the primary winding 5 of the ignition coil 6 and causing a high voltage pulse which results in a spark at the spark plug 43.

Upon increase of speed of the engine, the command current in primary winding 5 may not be reached anymore. This prevents blocking of the emitter-collector path of transistor 31, and thus prevents transistor 24 from becoming conductive. Consequently, capacitor 22 no longer will be discharged. As the control voltage on the capacitor 22 increases, the emitter-collector path of transistor 25 will become more and more conductive and thus the voltage at junction J, connected to the signal source 16 and Op Amp, 13, will increase, causing a shift in the zero or cross-over level of the control signal by superimposing a d-c value, as indicated in FIG. 2 by the broken line along the time axis t. Resistor 19 has the effect that the switching threshold levels Ue and Ua of the operational amplifier 13 follows this shift, so that they will then have the changed positions Ue' and Ua'. As can be seen, the time periods during which current flows over the primary winding 5 is increased, which insures that the requisite current flow to store sufficient electromagnetic energy in coil 6 will always be reached.

In accordance with the invention, excessive current flow is prevented at very low engine speeds, for example under engine starting or close-to-starting conditions.

The auxiliary capacitor 36 will have an auxiliary voltage formed thereon, derived from the signal source 16, which is obtained this way: During the negative half-wave, auxiliary capacitor 36 is charged over resistor 37 and diode 38. The negative half-wave has a peak value Uo. During the positive half-wave, with peak value Us, the auxiliary capacitor 36 is discharged over the circuit elements 39, 19, junction J, 40. Charge of the auxiliary capacitor 36 occurs only from a predetermined speed, that is, when the negative half-wave, with its negative peak value Uo, can exceed the threshold level of diode 38. Referring to FIG. 2, specifically, when the peak Uo exceeds the threshold level of diode 38, and at low speeds, the time period ta of the negative half-wave is longer than the time period tb associated with the wave having the positive peak Us; upon increase in speed, however, this will change. For example, if the speed has risen to the extent that the cross-over or zero or null level of the control signal has shifted to the extent that the broken-line time axis has become valid, the time period ta has decreased substantially, and the time period tb has increased. Consequently, the side or terminal or electrode of the auxiliary capacitor 36 closest to the current limiting resistor 37 will have a highly negative voltage after break-down of diode 38, which has as a consequence that the switching thresholds Ue and Ua of the threshold switch formed by the operational amplifier 13 change in the direction of the peak value Us. As the speed of the engine increases, the voltage at the terminal or electrode of auxiliary capacitor 36 close to the current limiting resistor 37 will again drop, so that the switching threshold levels Ue and Ua again return to their fixed distance from the zero or cross-over or null level of the control signal.

The circuit in accordance with the present invention thus modifies the switching threshold levels with respect to the cross-over level. Due to the shift of the switching thresholds Ue, Ua, which is caused by the auxiliary voltage built up on the auxiliary capacitor 36 and applied to the inverting input of operational amplifier 13, current is limited to flow through the primary winding 5 of the ignition coil 6 also under low speed, e.g. essentially idling conditions only for such a period of time as is necessary to store sufficient electromagnetic energy to generate an effective spark at the spark plug. At high speeds, a positive voltage is applied to the electrode of the auxiliary capacitor 36 facing the current limiting resistor 37 which can be utilized, desirably, to increase the time period of current flow through the primary winding 5. This positive voltage is with reference to the connection between the signal source 16 and the resistor 18.

When the voltage at the electrode of the capcitor 36 adjacent the current limiting resistor 37 is below the conduction voltage of the diode 38, it will not be effective and cannot act on the inverting input of operational amplifier 13. This insures that, upon starting of the engine, the switching thresholds Ue and Ua are always reached by the half-wave of the signal generator 16 having the peak value Us. Upon starting conditions, this peak value is relatively low, and the diode 38 insures that the thresholds will always be reached, in spite of the low peak value.

In a typical example for a 12 V operating system, capacitor 36 had a value of 1 $\mu$F; resistor 37=20K$\Omega$; resistor 39=10K$\Omega$; diode 38 had a breakdown or inherent conduction voltage of 0.5 V; operational amplifier 13, suitably, is type 3302, and the signal generator 16, under idle-speed conditions, has a voltage output with a voltage curve essentially as shown in FIG. 2, or capable of being modified to have an essentially similar voltage curve with, normally, peak values Uo and Us of $\pm$35 V (2000 r/min) which, under idle-speed conditions, changes to $\pm$12 V (400 r/min).

We claim:

1. Low speed compensated ignition system for an internal combustion engine, adapted for connection to a source of electrical power (1) having an ignition coil (5, 6, 42);

a controlled switch (7, 9) serially connected with said coil and controlling current flow therethrough;

means (8) sensing current flow through the ignition coil and deriving an electromagnetic storage signal;

a control signal generator (16) operating in form of an a-c generator and providing undulating signals in synchronism with the revolutions of the engine which have a positive peak value (Us) and a negative peak value (Uo) and a zero or null or center or cross-over line upon change of polarity of the signal;

a control circuit including a threshold switch (13) connected to receive the undulating signal connected to and controlling said controlled switch (7, 9) when the undulating signal is above the zero or null or cross-over level and is increasing in a positive direction from the negative peak value (Uo) and reaches, with respect to said zero or cross-over level, a first ON threshold level (Ue) to store electromagnetic energy in the coil, and interrupting conduction of the controlled switch (7, 9) and thus initiate release of electromagnetic energy from the coil to initiate an ignition spark pulse when the undulating signal is decreasing from a positive peak value (Us) and reaches, with respect to said zero or cross-over level, a second OFF threshold level (Ua), said control circuit being further connected to receive the electromagnetic storage signal to modify the response of the threshold switch in dependence on sensed current flow through the coil by shifting response to said threshold switch with respect to the change in polarity of the signal, and hence modifying the zero or null or cross-over level of the undulating signal as applied to the threshold switch, and comprising means for additionally modifying the ON threshold level with respect to the modified zero or null or cross-over level of the undulating signal under low-speed conditions to prevent excessive current flow through the coil including circuit means (36, 37, 38, 39, 19) responsive to low-speed conditions of the engine and hence of the control signal generator connected to said threshold switch (13) for introducing to said threshold switch an additional modifying signal affecting the first ON threshold response level thereof in a direction to delay response of the threshold switch and thus shorten the duration of conduction of said controlled switch (7, 9) and hence the duration of current flow through the coil (5, 6);

wherein said control system includes a circuit network (26) of variable conductivity connected (20, 21) to a terminal of said threshold siwtch (13);

the auxiliary capacitor (36) is connected to said terminal (inverting) of the threshold switch, said control signal generator (16) having one of its terminals connected to said terminal of the threshold switch;

and wherein the charging circuit for said auxiliary capacitor includes a serial resistor (37) diode (38) connection from said one terminal of the control signal generator (16) connection to the circuit network of variable conductivity (26);

and a coupling and calibrating resistor (39) is provided connected between the charging circuit connection and said auxiliary capacitor and said terminal of the control signal generator (16), to interconnect said control circuit, said circuit network of variable conductivity and said auxiliary capacitor and provide for modification of the response of the threshold switch (a) in accordance with the zero or null or cross-over of the undulating signal derived from the control signal generator, as modified by the circuit of variable conductivity, and (b) modification of the response threshold level of said threshold switch as modified by the auxiliary voltage applied by the auxiliary capacitor (36) and derived from said control signal generator.

2. System according to claim 1, wherein said low-speed condition responsive circuit means comprises means (36) for developing an auxiliary bias voltage, and connection means (37, 38, 39) applying said auxiliary bias voltage to the threshold switch to affect the ON threshold level thereof.

3. System according to claim 2, wherein said means developing the auxiliary bias voltage comprises an auxiliary capacitor (36) and charge circuit means (37, 38; 39, 18) therefor.

4. System according to claim 3, wherein said charge circuit means (37, 38, 39, 18) are connected to said control signal generator (16).

5. System according to claim 4, wherein said charge circuit means includes a voltage sensitive element (38) to prevent charging of said auxiliary capacitor and hence application of an auxiliary voltage if the output from said generator is below a predetermined level to prevent change in the threshold level under below-idling, and for example starting speed conditions.

6. System according to claim 1, wherein said threshold switch comprises an operational amplifier (13) and said terminal of the threshold switch comprises the inverting terminal thereof.

* * * * *